US006343816B1

(12) United States Patent
King

(10) Patent No.: US 6,343,816 B1
(45) Date of Patent: Feb. 5, 2002

(54) LOCK WITH LATERALLY-OUTWARDLY MOVABLE BOLT SUPPORTED IN A HOUSING

(76) Inventor: Wilhelm King, Schrambergerstr. 21, 78730 Lauterbach (DE)

( * ) Notice: Subject to any disclaimer, the term of this patent is extended or adjusted under 35 U.S.C. 154(b) by 0 days.

(21) Appl. No.: 09/591,772

(22) Filed: Jun. 9, 2000

Related U.S. Application Data

(63) Continuation of application No. 09/022,781, filed on Feb. 12, 1998, now abandoned.

(30) Foreign Application Priority Data

Jul. 11, 1997 (EP) ..... 97111820

(51) Int. Cl.[7] ..... E05C 1/12
(52) U.S. Cl. ..... 292/165; 292/DIG. 37
(58) Field of Search ..... 292/163–165, 292/174, 175, DIG. 4, DIG. 37, 74, 75; 70/379 R

(56) References Cited

U.S. PATENT DOCUMENTS 1,486,552 A * 3/1924 Swanson ..... 292/70
1,805,099 A * 5/1931 Kumber ..... 283/115
1,965,939 A * 7/1934 Jacobi ..... 70/29
2,573,061 A * 10/1951 Raymond ..... 70/81
3,057,649 A * 10/1962 Check ..... 292/74
3,830,535 A * 8/1974 Read ..... 292/170
3,919,866 A * 11/1975 Lipschultz ..... 70/81

* cited by examiner

*Primary Examiner*—Gary Estremsky
(74) *Attorney, Agent, or Firm*—Jansson, Shupe & Munger, Ltd.

(57) ABSTRACT

The invention involves an improvement to a cabinet door lock having a laterally-outwardly movable bolt that is supported in a housing and capable of being fixed in a locked position by means of a first stroke to a push button mechanism actuated perpendicular to the plane of the housing, and released from the locked position by the application of a second stroke to the push button mechanism. The improvement includes an oblique-shaped front side on the movable bolt, an oblique-shaped body stop positioned in the cabinet so as to contact the oblique-shaped front side of the movable bolt, and a compression spring pre-stressing the oblique-shaped movable bolt in an extended position when in the unlocked position, whereby the movable bolt is capable of sliding back into the housing when a traction force is exerted on the cabinet door.

6 Claims, 3 Drawing Sheets

LOCK WITH LATERALLY-OUTWARDLY MOVABLE BOLT SUPPORTED IN A HOUSING

RELATED APPLICATION

This application is a continuation of U.S. Pat. application Ser. No. 09/022,781 filed Feb. 12, 1998 now abandoned which claims priority under 35 USC §119 from European Application No. EP 97111820.3 filed in the European Patent Office on Jul. 11, 1997, now German Patent No. DE 197 36 792 A1.

FIELD OF THE INVENTION

The invention relates generally to a lock and, more particularly, to a lock with a laterally-outwardly movable bolt that is supported in a housing and can be fixed in the locked position when a push-button mechanism actuated perpendicular to the plane of the housing is arrested in a securing position, and released from the locked position when the push-button mechanism is pushed beyond the securing position.

BACKGROUND OF THE INVENTION

Such a push button actuated lock is known from German Patent No. DE3504806 C2. With this known lock a bolt that is movably supported in a housing slides laterally out of the lock housing, that is, it is brought into the locked position in parallel with the associated door in the mounted state, when a push button is pushed in perpendicular to the plane of movement of the bolt against a spring force, until it is arrested in a securing position. In this state the bolt can not slide back. To unlock it, the push button is released from the arrested state by depressing the push button beyond the securing position, thereby pulling the bolt back into the lock housing. The door is thus only secured when in the bolted position.

OBJECTS OF THE INVENTION

It is an object of this invention to provide a push button lock that overcomes some of the problems and shortcomings of devices of the prior art.

Another object of this invention is to provide a lock of the type indicated in the introduction that provides more security through the use of simple construction.

How these and other objects are accomplished will become apparent from the following descriptions and from the drawings.

SUMMARY OF THE INVENTION

The invention involves an improvement to a cabinet door lock having a laterally-outwardly movable bolt that is supported in a housing that defines a reference plane. The movable bolt is capable of being secured in a locked position when a push-button member, which is actuated by movement perpendicular to the reference plane, is in a securing position and released from the locked position when the push-button member is in a position beyond the securing position.

The improvement includes a compression spring biasing the movable bolt toward an extended position thereby allowing it to slide back into the housing having spaced parallel walls when a depressing force is applied to the bolt. The movable bolt has a pair of lateral members positioned along the inner walls and extending parallel to the direction of movement of the movable bolt. The lateral members have inner sides, each of which has a stop member thereon. The stop members have an abutment surface substantially perpendicular to the movement of the movable bolt, and the push-button member includes stop pins positioned for engagement with the abutment surfaces, whereby the movable bolt is prevented from sliding back farther into the housing when the push-button member is in the securing position.

According to the invention, it is provided that the movable bolt, when in the unlocked state, is biased in an extended position by means of a compression spring, but is held such that it can be slid back into the lock housing against the force of the spring, and that the movable bolt features an obliquity or roundness that acts together with a stop body, or is supported so as to swivel back. As a result of the bias resulting from the compression spring the movable bolt is also held in the extended state, that is in the extended position in the unlocked state, but can be moved back into the housing against the force of the compression spring when an appropriate traction force is exerted on the door. As a result of the obliquity or the roundness or the swiveling support, the movable bolt is moved into the housing by acting together with the counter surface on the body stop. The door can thus not swing open unintentionally when in the unbolted state. The reliability of operation is thereby increased according to the invention, in that the movable bolt features a stop member that blocks the movable bolt from sliding in when in the secured state, and that the stop member is released when the push-button member is depressed beyond the securing position.

In one embodiment of the invention, the movable bolt has an oblique-shaped front side, an oblique-shaped body stop is positioned in the cabinet so as to contact the oblique-shaped front side of the movable bolt, and the movable bolt is capable of sliding back into the housing when a traction force is exerted on the cabinet door. In a specific version of such embodiment, the front side of the movable bolt and the body stop are rounded.

According to the invention, the movable bolt, when in the unlocked state, is biased in an extended position by means of a compression spring, but is held such that it can be slid back into the lock housing against the force of the spring. In one embodiment of the invention, the movable bolt features an obliquity or roundness that acts together with a stop body. In another embodiment, the movable bolt is supported so as to swivel back.

As a result of the bias resulting from the compression spring the movable bolt is held in the extended state, that is, in the extended position in the unlocked state, but can be moved back into the housing against the force of the compression spring when an appropriate traction force is exerted on the door. As a result of the obliquity or the roundness or the swiveling support, the movable bolt is moved into the housing by acting together with the counter surface on the body stop thereby preventing the door from swinging open unintentionally when in the unbolted state. By appropriately arranging the body stop and the movable bolt, the door can be held in close contact with the body, so that annoying vibrating noises are avoided.

The invention increases the reliability of operation of the lock in that the movable bolt features a stop member that (1) blocks the bolt from sliding in when the push-button member is in the securing position, and (2) is released when the push-button member is depressed beyond the securing position.

If for some reason, the push-button member should be unintentionally moved during locking, the movable bolt will still remain freely movable. In this way, for example, a flap on which the lock is fastened can also be closed when the push button member is pushed in.

The construction of the lock is simple in an embodiment whereby the compression spring is arranged between a middle section of the back side of the movable bolt and the front side of a spring support platform that is fixed to the housing.

In addition to simple, compact construction, the features are further instrumental in that the movable bolt is guided along the inner walls of the lock housing by means of two lateral members. Guide paths that are oblique or curved from the housing cover are formed on the inner sides of the lateral members. It is these guide paths that the stop pins engage, with the result that, with the push-button member in the securing position, the movable bolt is blocked by the stop members against being pushed back in the housing, and the lateral members are guided past both sides of the spring support platform that is fixed to the housing.

In yet another embodiment of the invention, the compression spring is designed as a conical helical spring, and the back side of the bolt and the front side of the spring support platform feature recesses to which the respective facing end side of the compression spring is adapted. Such embodiment results in minimal block length for the spring thus allowing the assembly space for the compression spring to be designed with minimum dimensions.

The lock is easily constructed with a pin formed onto the floor of the lock housing and projecting into the inside of the housing. Inserted onto the pin is a screw shaped push button spring that elastically supports the push-button member in the direction of the housing floor. This allows the push-button member to be essentially guided out of the lock housing when in the unbolted state. The push-button member features a cross-shaped projection on the side opposite the rear side of the movable bolt. Such projection allows the push-button member to be guided in a cross-shaped guide groove that runs parallel to pin in the direction of movement of the push-button member. A tumbler with a gating mechanism is provided in a rear chamber of the lock housing, in which the free end of the cross-shaped projection that is directed away from the push-button member is set to the securing position when the push-button member is pressed, and out of which the cross-shaped projection can be released when the push-button member is pressed beyond the securing position.

The serviceability of the lock can be improved in that an ancillary spring is provided in addition to the push-button spring in order to support the push-button member in the extended state. Said ancillary spring is active in the initial phase of the inward movement of the push-button member, and is dimensioned such that when acting together with the push-button spring the need to push in the push-button member can be avoided, while the movable bolt is pushed into the lock housing against the force of the compression spring. The additional spring can be formed of bars which are part of the housing. Such bars can be swung out by means of nubs arranged on the push-button member.

DETAILED DESCRIPTIONS OF THE PREFERRED EMBODIMENTS

Figure 1A:
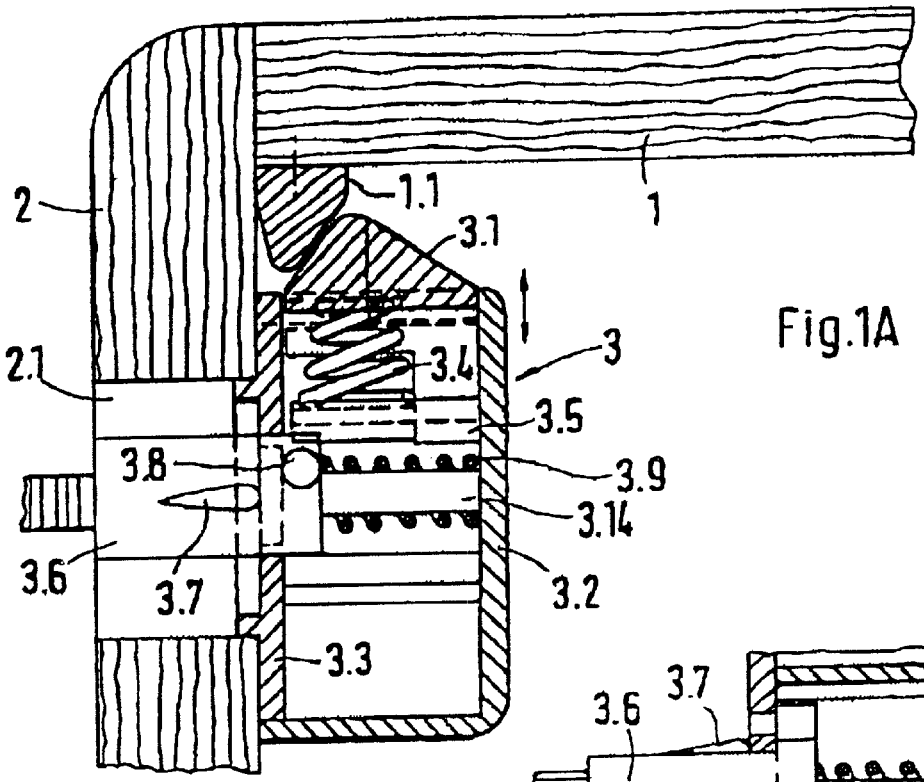
FIG. 1A is a sectioned lateral view of the lock in an assembled state.
Figure 1B:
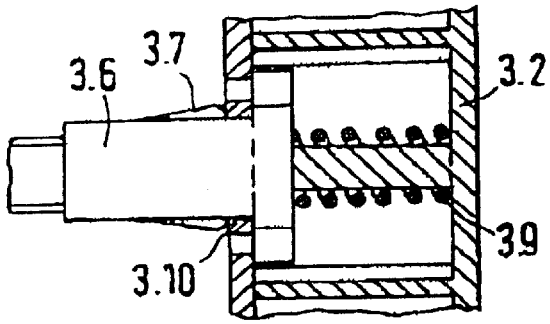
FIG. 1B is a cross-section of the lock shown in FIG. 1A.

FIG. 1A shows a lock 3 mounted on a door 2 of a furniture body 1. The lock 3 is mounted on the inside of door 2 and projects, by means of a push-button member 3.6, through a door recess 2.1 in the illustrated unlocked state. In the final assembled state an actuation push button is screwed on an outwardly extending section of thread, or is fastened in a similar way. The push-button member 3.6, at the other side, projects through an opening in a housing cover 3.3 into a lock housing 3.2 and is supported on its underside at the housing floor by means of a push button spring 3.9 in the form of a coil spring, which is inserted on a pin formed onto the housing floor, as is shown in FIG. 1B.

Figure 1C:
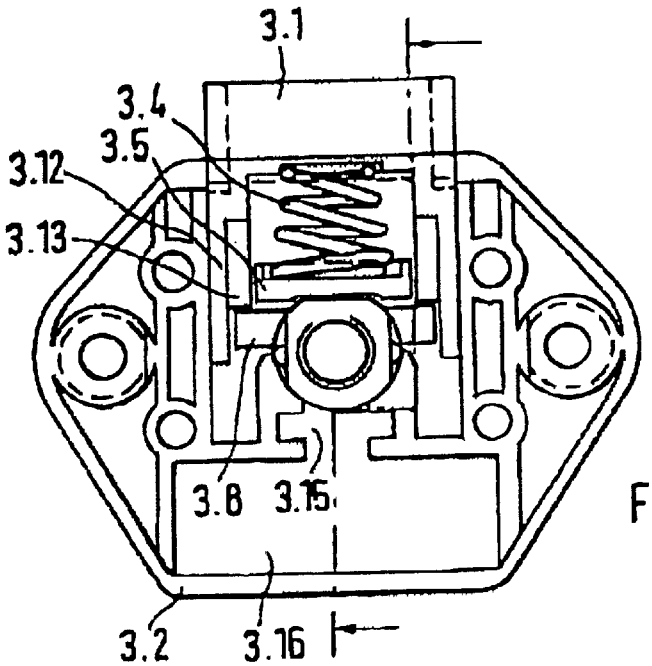
FIG. 1C is a top view of the lock shown in FIG. 1A with the housing cover removed.

Parallel to the door 2, a movable bolt 3.1 is mounted in the lock case 3.2 such that it can be pushed out through a side wall. The displacement direction is specified by a double arrow in FIG. 1A. In the central region, as can also be seen from FIG. 1C, the movable bolt 3.1 is supported on a housing-mounted spring support platform that includes a first recessed portion, by means of a conical compression spring 3.4 having a first and a second end. The rear side of the movable bolt 3.1 includes a second recessed portion, and the first recessed portion of the spring support platform and the second recessed portion of the movable bolt are adapted to receive the respective first and second ends of the compression spring. Such design of the compression spring 3.4 results in a minimal compressed length and makes it possible to provide minimal receiving space.

Figure 2:
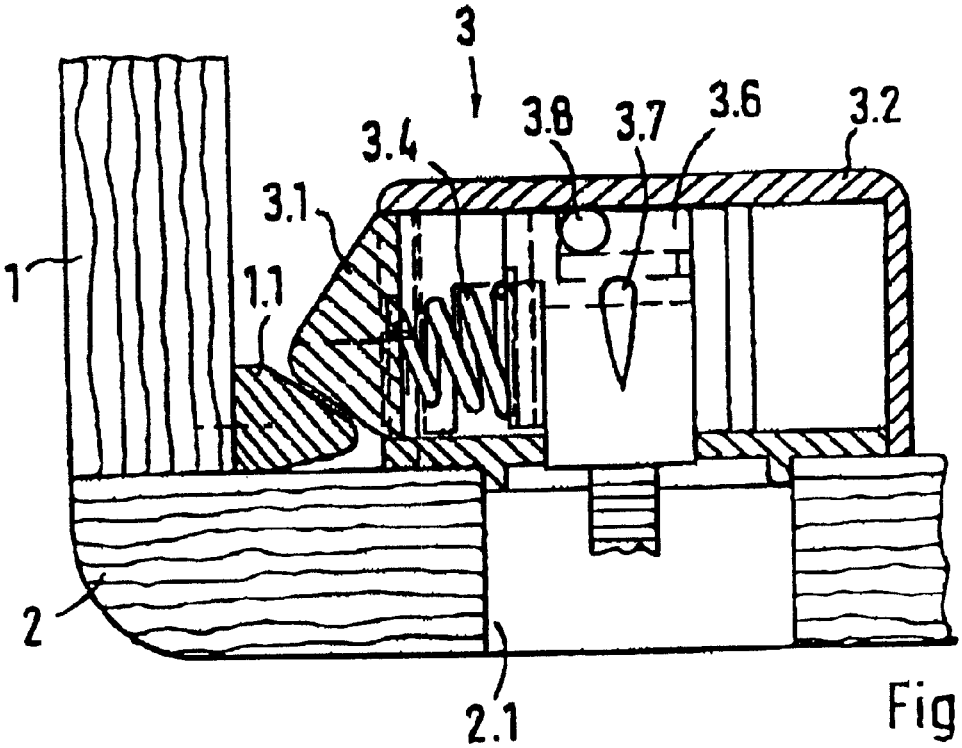
FIG. 2 is the lock shown in FIG. 1A in the bolted state.

A movable bolt 3.1 is guided so as to slide on the inner walls of the lock housing 3.2 with lateral members 3.12. A guide path 3.13 is formed on the inner sides of lateral members 3.12 that face each other, into which stop pins 3.8 that project from both sides from the push-button member 3.6 engage. The guide paths 3.13, as viewed from the housing cover 3.3, extend from the front side facing the front side of the movable bolt 3.1 in an oblique or curved manner toward the back and form stop members 3.17 for the stop pins 3.8 in its end area facing the housing floor, so that the movable bolt 3.1 is secured from sliding back by means of the stop pin 3.8, as is shown in FIG. 2.

From FIG. 1A it can be seen that the movable bolt 3.1 is also held in the extended state by means of the compression spring 3.4 when the push-button member 3.6 is pushed out into the unlocked position with the push button. In this case door 2 is also held closed through the contact of movable bolt 3.1 on body stop 1.1, so that it can not simply swing open. If, however, an appropriate traction force is exerted on the door, then movable bolt 3.1 can be pushed back into the inside of lock housing 3.2 against the spring force of compression spring 3.4 by gliding along the obliquity on the stop body 1.1, so that the door can be opened. From this action it can be seen that guide path 3.13 need not necessarily extend obliquely into the housing. Instead, it is sufficient that an appropriate path be provided to push movable bolt 3.1 back when in the extended state of the push button member 3.6.

In FIG. 1B the pushed-out state of the push button with the push-button member 3.6 is also illustrated, whereby it is supported on the housing floor by means of the push-button spring 3.9. In addition to the push-button spring 3.9 another spring force is formed by a lateral ancillary spring 3.10 that acts together with nubs 3.9 provided laterally on the push-button member 3.6. The ancillary springs 3.10 are formed from bars and recesses in the cover of the housing. During the closing phase of the door 2 the ancillary springs 3.10 provide increased spring pressure against pressing in the push button, so that movable bolt 3.1 is pushed back against the action of the compression spring 3.4, before the push button with the push-button member 3.6 is extended into the lock housing. As a result of this dimensioning of the spring forces it is ensured that lock 3 does not lock before the door 2 is closed.

To arrest the push-button member 3.6 in the securing position, a non-illustrated, cross-shaped projection is formed on the rear side of the push-button member 3.6 facing away from movable bolt 3.1, supported so as to slide parallel to the direction of movement of push-button member 3.6 in a cross-shaped guide groove 3.15. In a rear chamber 3.16 of lock housing 3.2 a non-illustrated tumbler with a gating mechanism is arranged, into which the free end of the cross-shaped projection facing away from movable bolt 3.1 projects and in which it engages. The push-button member 3.6 can again be released by pressing the push-button member 3.6 beyond the securing position as shown in FIG. 4.

Figure 3:
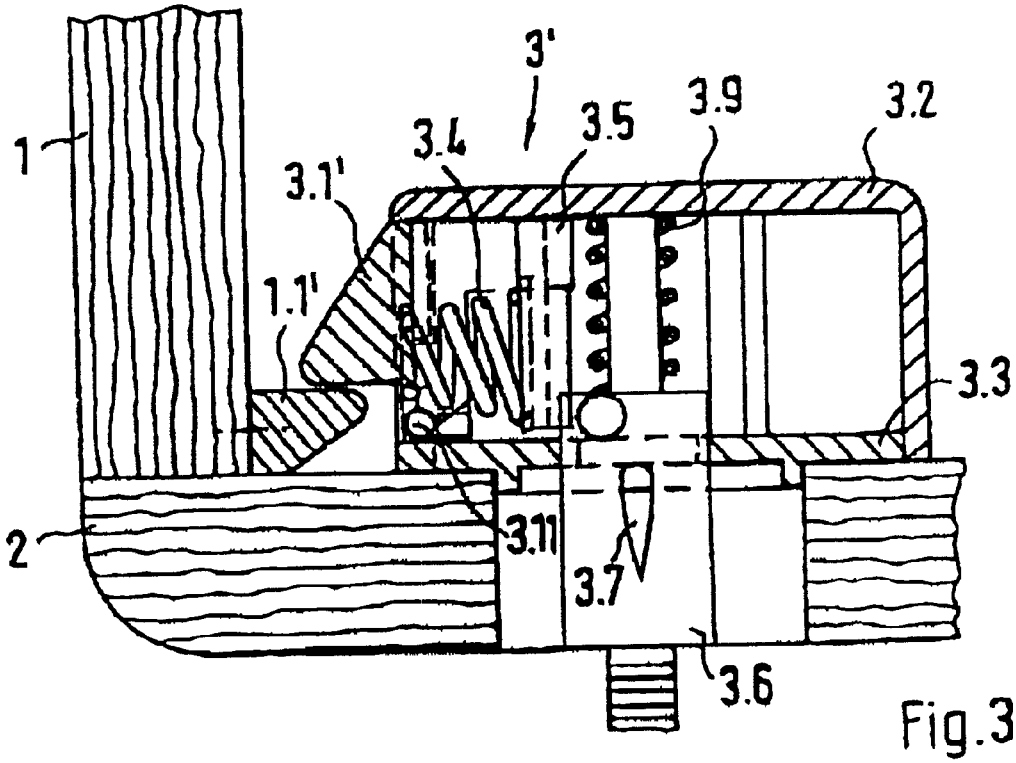
FIG. 3 is a sectioned lateral view of another embodiment of the lock in an assembled state.

A further exemplified embodiment is shown in FIG. 3, whereby bolt 3.1', in contrast to the previous exemplified embodiment, is not supported so as to slide, but rather can swivel around an axis of rotation 3.11. The axis of rotation 3.11 is in the area of the lateral wall of lock housing 3.2 that is allocated to the front side of the bolt, and is arranged near housing cover 3.3.

With this form of embodiment the surfaces of stop body 1.1' that face each other and bolt 3.1' have a flat design, since bolt 3.1' can swivel back against the force of the compression spring 3.4 when an appropriate tug is exerted on the door in the extended state of the push-button member 3.6. The bolting by means of push-button member 3.6 takes place as in the preceding exemplified embodiment.

Figure 4:
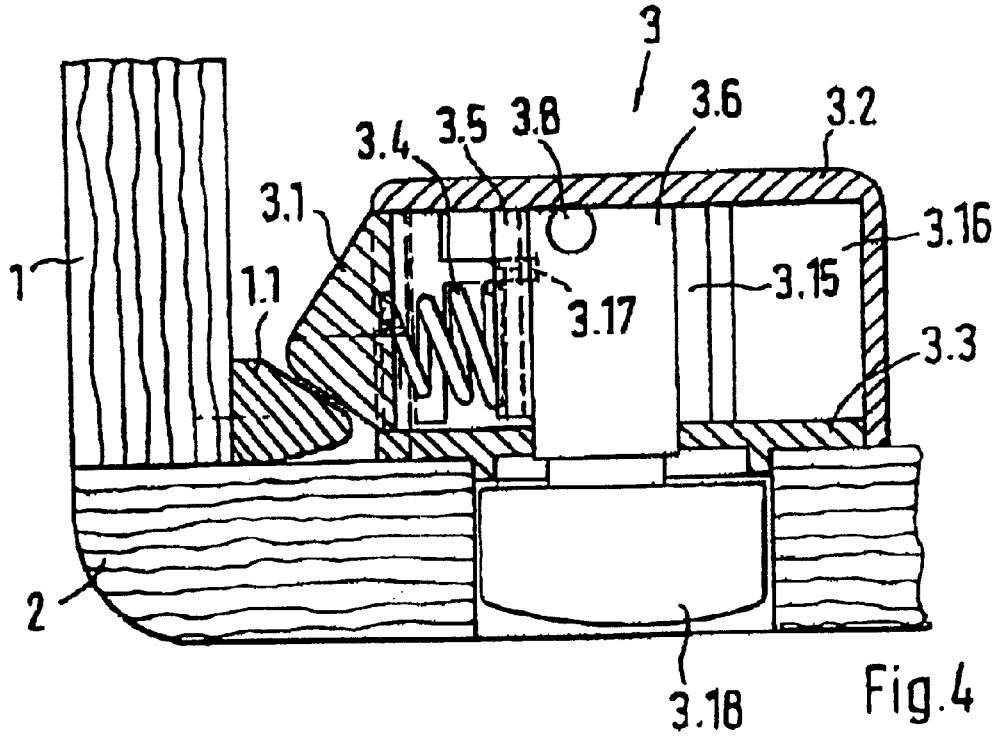
FIG. 4 is a variant of the lock shown in FIGS. 1A–1C in lateral and in section.

In FIG. 4 another variant of a lock is shown. In this case there is a modification relative to the lock shown in FIG. 1. The design of both of these locks, however, is extensively the same. Modifications are essentially provided on movable bolt 3.1 and housing lid 3.3. The spring tension of the push-button spring 3.9 and the compression spring 3.4 are synchronized with each other such that door 2 can readily be closed by actuating push button 3.18. When movable bolt 3.1 glides by body stop 1.1 push-button spring 3.9 can not yet be compressed. This is only possible if door 2 is located in the closed state. This simple measure can eliminate ancillary spring 3.10 on housing lid 2.3. Furthermore, the operational reliability of the lock is increased. It is always ensured that movable bolt 3.1 snaps in first on body stop 1.1, before the blocking of the bolt takes place with push-button member 3.6.

If the spring tensions cannot be synchronized as in the previously described manner, or if, for example parameter changes occur as a consequence of different conditions of application or wear, then a further measure that ensures operational reliability is taken on the lock according to FIG. 4. Additionally, movable bolt 3.1 is designed such that it features stop 3.17, blocking stop pin 3.8 of push-button member 3.6. Stop 3.17 is thereby designed and arranged such that it is blocked by the stop pin only in the pushed in and engaged position of push-button member 3.6. The bolt thereby remains freely movable during the insertion of push-button member 3.6. This makes it possible for the engagement of movable bolt 3.1 to take place independent of the positioning of push-button member 3.6. In the event that, when pressing in push-button member 3.6, stop pin 3.8 grasps stop 3.17 at the exact moment at which movable bolt 3.1 is swung out at body stop 1.1, then push-button member 3.6 can be moved beyond the securing position, as is shown in FIG. 4. It can be seen that the measures of (1) adjustment of the spring tension of the push button spring 3.9 and the compression spring 3.4 and (2) arrangement and design of the stop 3.17 can be embodied on a lock either together or independent of each other.

Figure 5:
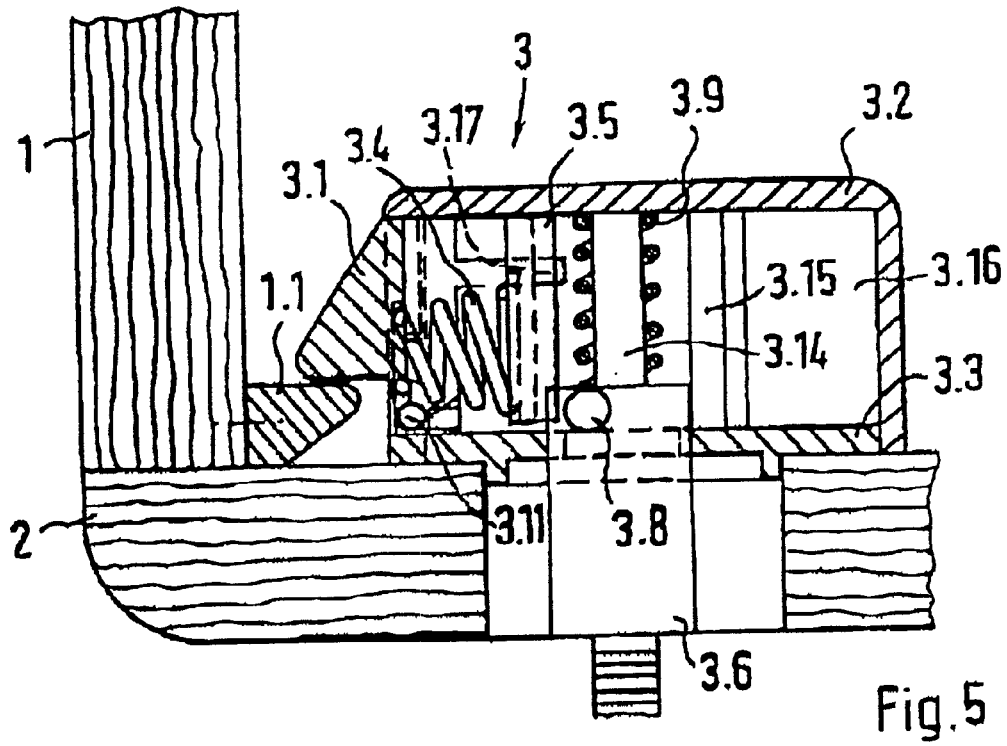
FIG. 5 is a variant of the lock shown in FIG. 3 in lateral view and in section.

In FIG. 5 a modification of the lock is shown according to FIG. 3. In this modification the above specified measures to increase operational reliability have been embodied.

While the principles of this invention have been described in connection with specific embodiments, it should be understood clearly that these descriptions are made only by way of example and are not intended to limit the scope of the invention.

What is claimed:

1. In a cabinet door lock having a laterally-outwardly movable bolt that is supported in a housing defining a reference plane, the bolt being (1) secured in a locked position within the housing when a push-button member, which is actuated by movement perpendicular to the reference plane, is in a securing position and (2) released from the locked position when the push-button member is in a position beyond the securing position, the improvement comprising:

a compression spring biasing the movable bolt toward an extended position thereby allowing it to slide back into the housing when depressing force is applied thereto;

the housing having spaced parallel walls;

the movable bolt having a pair of lateral members positioned along the inner walls and extending parallel to the direction of movement of the movable bolt, the lateral members having inner sides each of which has a stop member thereon which includes an abutment surface substantially perpendicular to the movement of the movable bolt; and the push-button member having stop pins thereon positioned for engagement with abutment surfaces, whereby the movable bolt is prevented from sliding back farther into the housing when the push-button member is in the securing position.

2. The lock according to claim 1 wherein:

the movable bolt has an oblique-shaped front side; and an oblique-shaped body stop is positioned in the cabinet so as to contact the oblique-shaped front side of the movable bolt.

3. The lock according to claim 2 wherein the front side of the movable bolt and the body stop are rounded.

4. The lock according to claim 1 wherein:

the movable bolt has a rear side;

a spring support platform is fixed to the housing; and the compression spring is positioned between a middle section of the movable bolt and the spring support platform.

5. The lock according to claim 1 wherein:

guide paths are formed by the lateral members and stop members;

the stop pins engage the guide paths in such a manner that the stop pins engage the abutment surfaces when the push-button member is in the securing position.

6. The lock according to claim 4 wherein:

the spring support platform has a front side that includes a first recessed portion;

the rear side of the movable bolt includes a second recessed portion;

the compression spring is a conical coil spring having a first and a second end; and the first recessed portion of the spring support platform and the second recessed portion of the movable bolt are adapted to receive the respective first and second ends of the compression spring.

* * * * *